US006210149B1

(12) United States Patent
Plavnik et al.

(10) Patent No.: US 6,210,149 B1
(45) Date of Patent: Apr. 3, 2001

(54) PULSE COMBUSTION SYSTEM AND METHOD

(76) Inventors: Zinovy Z. Plavnik, P.O. Box 451284, Atlanta, GA (US) 31145; Vitaly S. Severyanin, 14 Gavrilov Street, Apt. 31, Brest (BY), 224028; Lawrence M. Matta, 2141 Summerchase Dr., Woodstock, GA (US) 30189; Vitaly L. Feingold, 2773 Heath La., Duluth, GA (US) 30096

( * ) Notice: Subject to any disclaimer, the term of this patent is extended or adjusted under 35 U.S.C. 154(b) by 0 days.

(21) Appl. No.: 09/316,225

(22) Filed: May 21, 1999

Related U.S. Application Data

(60) Provisional application No. 60/086,697, filed on May 26, 1998.

(51) Int. Cl.[7] ..... F23C 11/04

(52) U.S. Cl. ..... 431/1; 431/1; 432/25; 432/186

(58) Field of Search ..... 431/1, 9, 350, 431/353, 75; 60/39.77; 122/24; 34/539; 126/116 R; 432/25, 186

(56) References Cited

U.S. PATENT DOCUMENTS

| | | | | |
|---|---|---|---|---|
| 2,719,580 | | 10/1955 | Haag et al. | 158/4 |
| 2,838,102 | | 6/1958 | Reimers | 158/4 |
| 2,907,382 | | 10/1959 | McIlvaine | 158/4 |
| 2,929,210 | * | 3/1960 | Howes . | |
| 3,540,710 | * | 11/1970 | Urawa | 263/40 |
| 4,061,463 | | 12/1977 | Bennett | 431/9 |
| 4,260,361 | | 4/1981 | Huber | 431/1 |
| 4,309,977 | * | 1/1982 | Kitchen | 431/1 |
| 4,808,107 | | 2/1989 | Yokoyama et al. | 431/1 |
| 4,840,558 | | 6/1989 | Saito et al. | 431/1 |
| 5,044,930 | * | 9/1991 | Hongo et al. | 431/1 |
| 5,285,769 | * | 2/1994 | Wojcicki | 431/1 |

FOREIGN PATENT DOCUMENTS

| | | | | |
|---|---|---|---|---|
| 59-15710 | * | 1/1984 | (JP) | F23C/11/04 |
| 59-2000108 | * | 11/1984 | (JP) | F23C/11/04 |
| 62-162822 | * | 7/1987 | (JP) | F23R/7/00 |
| 2-263003 | * | 10/1990 | (JP) | F23C/11/04 |
| 8-210774 | * | 8/1996 | (JP) | F23C/11/04 |

* cited by examiner

*Primary Examiner*—Carl D. Price
(74) *Attorney, Agent, or Firm*—Bernstein & Associates, P.C.; Jason A. Bernstein

(57) ABSTRACT

A pulse combustion system having at least one combustion chamber, having an outlet end of a generally coaxial air conduit, a fuel nozzle, and an ignitor arranged generally in a first section of the chamber, and having a tangential exhaust pipe arranged generally in a second section of the chamber. At least one primary exhaust pipe extends from the combustion chamber and a plurality of secondary exhaust pipes extend from the primary pipe. An enclosure is disposed about the combustion chamber and exhaust pipes, with a blower in communication with the enclosure.

Also, a pulse combustion method of transferring heat to a material, generally including the steps of setting up a helical swirl of thermal and acoustic pulse waves within a chamber, expanding the waves along a length of the chamber, and propagating the waves tangentially out of the chamber into a resonant exhaust manifold and onto a material.

41 Claims, 8 Drawing Sheets

PULSE COMBUSTION SYSTEM AND METHOD

CROSS-REFERENCE TO RELATED APPLICATION

This application claims the priority benefit of U.S. Provisional Application Ser. No. 60/086,697, filed May 26, 1998, which is hereby incorporated by reference in its entirety.

FIELD OF THE INVENTION

The present invention relates generally to pulse combustion, and more particularly, to a combustion chamber assembly for generating thermal and acoustic pulses and a resonant exhaust manifold system for propagation and application of the thermal and acoustic pulses to a material.

BACKGROUND OF THE INVENTION

Many industrial processes are effected to provide heat and mass transfer to a material. Increased rates of heat and mass transfer are desired to increase the efficiency and productivity of such processes. Applications for such processes include food processing, carpet and textiles manufacturing, packaging and sealing, wood fiber processing, glass forming, sheet metal forming, and drying, curing, baking, sintering and like heat treating processes for a wide range of materials and compositions.

Many such industrial processes are implemented by the use of a conveyor that moves the material through a space where it may be impinged or otherwise acted upon by a combustion system to accomplish the desired heat and mass transfer. One known arrangement provides an enclosure heated by a combustion system and having entrance and exit apertures for conveying material therethrough to direct and apply heat to the material, as illustrated by the drying and curing oven of U.S. Pat. No. 4,061,463 to Bennett.

Additionally, there are known combustion systems that provide a pulsating combustion cycle. The general operational principle of such pulse combustion systems is that a fuel/air mixture is ignited within a combustion chamber which increases the pressure therein resulting in exhaustion of the combustion products from the combustion chamber causing a subsequent pressure decrease which draws additional fuel and air into the combustion chamber for ignition, thereby setting up a cycle of pulsing detonations.

Such pulse combustion systems generally provide several advantages over most non-pulsating systems, including the advantages of self-aspiration and higher thermal efficiency of the process. These systems may be self-aspirating because the above described pressure fluctuations cyclically draw combustion material into the combustion chamber to sustain the combustion process. Therefore, a blower is not required for supplying air after start-up. Additionally, these systems may provide a higher thermal efficiency because the pulsating cycles create acoustic pulse waves that break down boundary layers and thus provide for greater heat and mass transfer rates. Also, thermal efficiency may be increased by the pulsating cycles producing a greater mixing of fuel and air and thus providing for a more complete burning of the combustion materials.

One known type of pulse combustion system provides two burners connected in parallel to an air intake, with each burner operating at a phase difference of 180 degrees from the other burner, as illustrated by U.S. Pat. No. 2,838,102 to Reimers, U.S. Pat. No. 4,808,107 to Yokoyama et al., and U.S. Pat. No. 4,840,558 to Saito et al. These systems commonly include a heat exchanger for. heat transfer to a fluid for use in applications such as water and oil heating. There are no known anti-phase type self-aspirating or forced air pulse combustion systems adapted for directing and applying thermal and/or acoustic energy to a material in a conveyor type application.

Another known type of pulse combustion system provides a spherical combustion chamber with an air intake tube extending radially into the combustion chamber to provide a more central point of combustion within the chamber, and a resonant exhaust tube extending from the chamber, as illustrated by U.S. Pat. No. 2,719,710 to Haag et al. and U.S. Pat. No. 4,260,361 to Huber. Such centralized point of combustion generally does not promote complete combustion within the combustion chamber prior to exhaust because such systems generally do not produce the desired turbulence achieved by a fully developed thermal and acoustic pulse wave.

Additionally, there is known the combustion system of Saito et al., as described above, and the gas furnace system disclosed in U.S. Pat. No. 3,540,710 to Urawa, that each provide a combustion chamber with tangential air intake orifices. Neither of these combustion systems, however, have a resonant exhaust pipe system that efficiently propagates an acoustic and/or thermal pulse wave for application to a material, provide a point of combustion within the combustion chamber that sets up and fully develops the desired turbulence of an acoustic and/or thermal pulse wave, nor provide a combustion chamber that advantageously directs an acoustic and/or thermal pulse wave toward such an exhaust pipe system.

An additional deficiency of many known pulse combustion systems is the complicated valve and/or control systems employed to control combustion and heat output by regulating the flow rate and ratio of air and fuel, as illustrated by U.S. Pat. No. 4,808,107 to Yokoyama et al. discussed heretofore. Such complicated valve systems are often difficult to maintain in proper adjustment and operating order. A further deficiency of many pulse combustion systems is that generally the systems are necessarily designed for a specific application such as water heating, because the combustion chamber and exhaust pipe must be specifically designed to set up the desired natural harmonic frequency at which the system should operate.

Accordingly, what is needed but not found in the prior art is a combustion system and method that embodies pulse combustion principles in an apparatus for conveyor type heat and mass transfer processes for achieving increased thermal efficiency and self-aspiration, that provides a combustion chamber for setting up and fully developing high turbulence, high velocity thermal and acoustic pulse waves, that provides a resonant exhaust piping system for propagating and directing without impeding the thermal and acoustic pulse waves to a material, that provides for temperature control without the need for a complicated valving and control system, and that has a design that is modular, simple, and cost-effective to manufacture and use for a variety of different applications.

SUMMARY OF THE INVENTION

Generally described, the present invention provides a pulse combustion system. A preferred embodiment of the present invention has at least one generally cylindrical combustion chamber having at least one endwall, at least one curved sidewall, and an exhaust outlet defined in the curved sidewall at a position generally proximate to the endwall.

At least one air conduit is preferably provided extending coaxially through the endwall of the combustion chamber and extending coaxially into the combustion chamber such that an outlet end of the air conduit is spaced apart from the exhaust pipe outlet to the combustion chamber. At least one fuel nozzle is preferably provided extending into the combustion chamber and spaced apart from the exhaust pipe outlet to the combustion chamber. At least one igniter is preferably provided associated with the combustion chamber. The spaced apart relationship of the air conduit outlet and the exhaust pipe outlet to the exhaust pipe outlet is preferably provided by the exhaust pipe outlet being arranged within a second half of the combustion chamber and the air conduit outlet and the fuel nozzle each arranged within a first half of the combustion chamber.

At least one resonant exhaust manifold is preferably provided having at least one primary exhaust pipe with a first end extending from the combustion chamber and in alignment with the exhaust outlet. The primary pipe comprises a distribution member, and the manifold includes a plurality of secondary exhaust pipes extending from the distribution member. At least one heat exchanger fin is preferably removably coupled to the primary exhaust pipe.

An enclosure is preferably provided generally disposed about the combustion chamber and exhaust pipes, the enclosure having at least one cooling air inlet, at least one cooling air outlet, and at least one partition interposed between the combustion chamber and the secondary exhaust pipes. A blower is preferably provided associated with the cooling air inlet of the enclosure.

In operation, fuel is entered into the combustion chamber through the fuel nozzle orifices, air is entered into the combustion chamber through the air conduit and mixes with the air, and the fuel/air mixture is ignited by the igniter to generate thermal and an acoustic pulse waves. The burning mixture expands in a helical swirl about the air conduit and along the length of the combustion chamber and then the burnt mixture/exhaust gas tangentially exhausts from the combustion chamber through the tangential primary exhaust pipe. The hot exhaust gas then propagates through the primary and the secondary exhaust pipes, and the hot exhaust gas exits from the outlet ends of the secondary pipes and is directed toward a material.

The present invention also provides a pulse combustion method of transferring heat to a material. The method preferably comprises the steps of forcing air through an axial conduit into a first half portion of an elongated cylindrical combustion chamber, injecting fuel into the first half portion of the combustion chamber wherein the fuel mixes with the air, igniting the fuel/air mixture generally within the first half portion of the combustion chamber such that the ignition of the combustion mixture generates thermal and acoustic pulse waves and the burning combustion mixture expands in a helical swirl about the air conduit and along a length of the elongated chamber from the first half of the combustion chamber toward a second half portion of the combustion chamber, exhausting the swirling burnt mixture from the combustion chamber in a tangential direction and into a primary resonant exhaust pipe attached tangentially thereto generally at the exhaust outlet of the chamber second half, propagating the thermal and acoustic pulse waves of the burnt mixture/exhaust gas through an angled distribution member of the primary resonant exhaust pipe, propagating the exhaust gasses through a plurality of secondary resonant exhaust pipes extending from the distribution member, and directing the exhaust gasses out of the secondary pipe outlet ends and toward a material, directing the thermal and acoustic pulse waves of the exhaust gas from the resonant exhaust pipe toward a material, and drawing a subsequent cycle of air through the axial conduit into the first half of the elongated cylindrical combustion chamber for sustaining cycles of a pulsating combustion.

Accordingly, it is an object of the present invention to provide a pulse combustion system for heat and mass transfer processes, the system having a design that is modular, simple and cost-effective to manufacture and use for a variety of different applications.

It is another object to provide a pulse combustion system that has a high thermal efficiency and is self-aspirating.

It is yet another object to provide a pulse combustion system that provides a combustion chamber with an off-center point of combustion for setting up a helical swirl of combustion gases along an axial length of the combustion chamber, and filly developing high turbulence, high velocity thermal and acoustic pulse waves associated with the swirling gases.

It is a further object to provide a pulse combustion system having an exhaust manifold with at least one primary exhaust pipe tangentially attached to the combustion chamber for exhausting the combustion gases from the chamber without impeding the associated thermal and acoustic pulse waves.

It is still another object to provide a pulse combustion system having an exhaust manifold with a plurality of secondary exhaust pipes extending from the primary exhaust pipe for propagating without impeding the thermal and acoustic pulse waves therethrough, and for directing and applying the thermal and acoustic pulse waves to a material.

It is a further object to provide a pulse combustion system having a plurality of thermal conductive fins removably coupled to the primary exhaust pipe, an enclosure with partitions therein forming air passageways therethrough, and a blower for directing air into the enclosure for temperature control of the combustion system.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
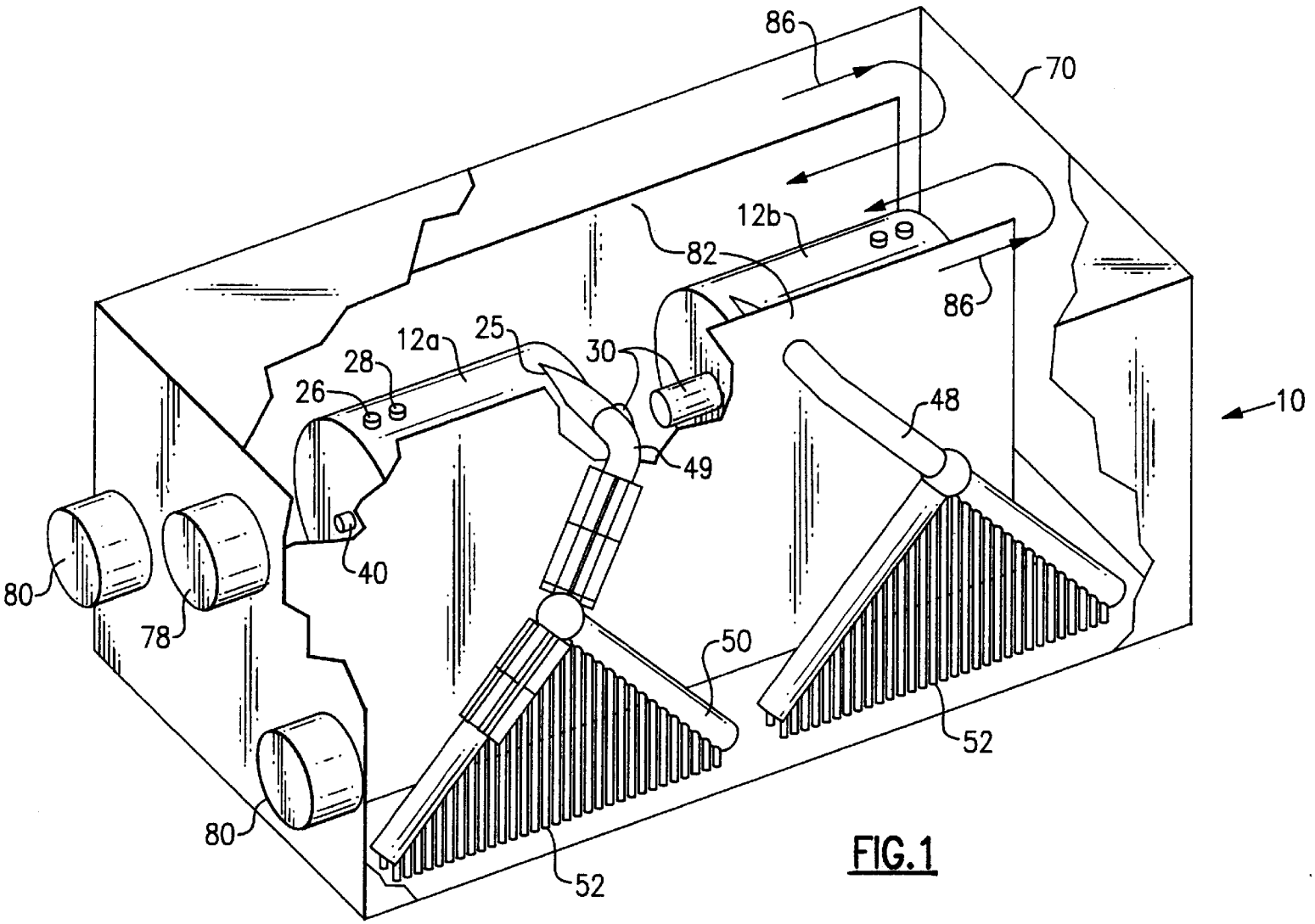
FIG. 1 is a perspective view of a first preferred embodiment of the present invention.

Referring to FIG. 1 here and throughout, there is illustrated a first preferred embodiment of the pulse combustion system 10 of the present invention. The invention hereof will now be described in particularity and with reference to the corresponding figures.

Figure 2:
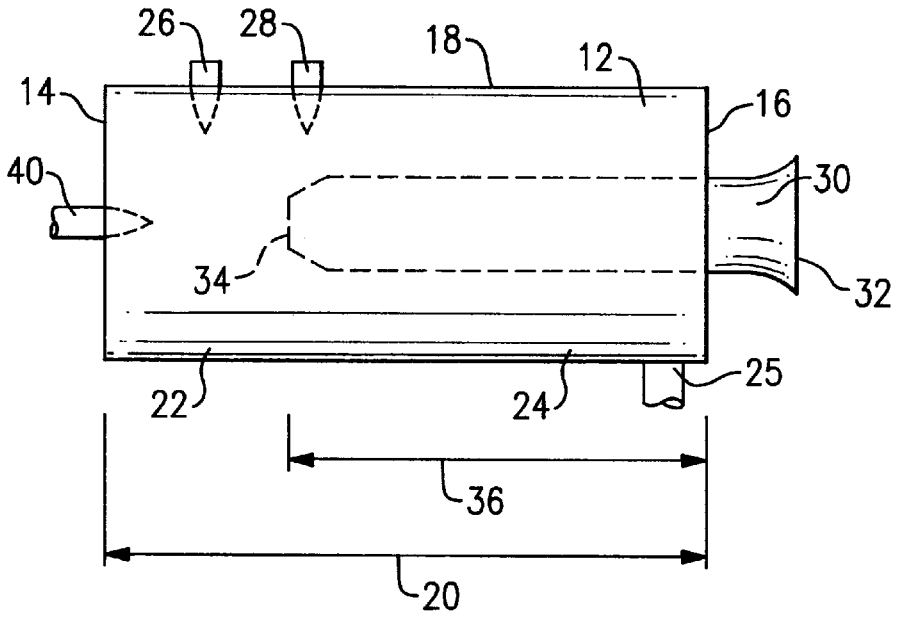
FIG. 2 is a side view of the combustion chamber of the first preferred embodiment.

Referring now to FIG. 2, there is provided a combustion chamber 12 for combusting fuel and air and for generating thermal and acoustic pulse waves. The chamber 12 generally has a first endwall 14, a second endwall 16, and a sidewall 18, and is preferably elongated with a generally cylindrical shape. Optionally, the chamber 12 may be provided in an ellipsoidal, parabolic, spherical, conical, or other regular or irregular geometric shape such that at least a portion the sidewall 18 is curved. The chamber 12 is typically provided in a horizontal position, though the chamber 12 is freely arrangement in other configurations, one of which will be described hereinafter in a third embodiment. The chamber 12 may be constructed of a metal, ceramic, synthetic, or like high-heat resistant material, using fabrication techniques known by those skilled in the art.

Preferably, two chambers are provided in the combustion system 10, shown in FIG. 1 as 12*a* and 12*b* and collectively referred to hereinafter as chamber 12. Optionally, any number of chambers 12 may be incorporated into the system depending on the amount of heat transfer desired and the area over which the heat is to be directed. The size of the chamber 12 is selected based on the desired combined velocities of the thermal and acoustic pulse waves within the chamber 12 and the amount of heat to be delivered to the material. The chamber 12 has an interior length 20, the midpoint of which may be thought of to divide the chamber into a first half portion 22 and a second half portion 24.

An exhaust outlet 25 is provided in the second half 24 of the combustion chamber 12. Preferably, the exhaust outlet 25 is defined in the sidewall 18 generally adjacent the first endwall 16 of the chamber 12. The exhaust outlet 25 preferably allows for tangential attachment of an exhaust pipe, as described in detail hereinafter.

An ignitor 26 is provided preferably extending into or flush with an inner sidewall of the chamber 12. The ignitor 26 preferably comprises a conventional spark plug with ignition wiring and controls. Optionally the ignitor 26 may be provided by a pilot burner, piezoelectric, electronic, or another ignition device known to those skilled in the art The ignitor 26 is preferably removably installed, for example, by providing a threaded portion that engages a threaded portion of the first endwall 14 or sidewall 18. Optionally, the ignitor may be permanently installed, as may be preferable for a pilot burner.

The ignitor 26 is spaced apart from the exhaust outlet 25 of the second half 24 of the chamber, where the spaced apart relationship is preferably provided by the ignitor being positioned in the first half 22 of the chamber 12. The exact location of the ignitor 26 is not critical, for example, the ignitor 26 may be positioned on most any portion of the first endwall 14 or the sidewall 18 of the combustion chamber 12, or even positioned outside the combustion chamber 12.

A flame sensor 28 is preferably provided that senses the presence of a flame in the combustion chamber 12, and in the absence of a flame, cuts off fuel to the combustion chamber 12. The flame sensor 28 is of a conventional type such as a high temperature metal alloy provided with a small sensing current, an ultra-violet sensor, or another flame sensor known to those skilled in the art. The flame sensor 28 is preferably positioned in the first half 22 of the chamber 12 generally proximate the ignitor 26, but may be positioned in any location selected such that it may sense the presence of a flame.

An air conduit 30 is provided for intaking air into the combustion chamber 12. The air conduit 30 is preferably tubular and extends through the second endwall 16 and coaxially at least partially into the chamber 12. The air conduit has an inlet end 32 and an outlet end 34. The inlet end 32 may be tapered outward and the outlet end 34 may be tapered inward in order to prevent a backflow of combustion products, to reduce sound emissions, and to increase the velocity and turbulence of the combustion products. The air conduit 30 is preferably provided without any movable constrictions therein such as valves or the like, thereby providing for a free flow of air through the conduit 30 into the chamber 12 to permit the pulsating combustion to freely draw air into the chamber 12 for sustaining the pulsating combustion. Optionally, the outlet end 34 may be provided with a surface having angled orifices defined therein or protuberances extending therefrom for inducing a rotary airflow from the conduit 30 into the chamber 12, and/or the conduit 30 may have a generally rifled exterior surface, to promote a helical swirl about the air conduit 30 as described in more detail hereinafter.

The outlet end 34 of the air conduit is spaced apart from the exhaust outlet 25 of the second half 24 of the chamber 12, where the spaced apart relationship is preferably provided by the outlet end 34 being positioned in the first half 22 of the chamber 12. In other words, the air conduit 30 has a length 36 within the combustion chamber 12 that is preferably between about 50 to 100 percent of the length 20 of the combustion chamber 12. Optimally, the air conduit 30 has a length 36 within the combustion chamber 12 that is preferably between about 70 to 75 percent of the length 20 of the combustion chamber 12. The exact axial position of the outlet end 34 within the first half 22 is not critical. It should be noted that optionally the outlet end 25 may be arranged within the second half 24 of the chamber 12 with lesser, but nevertheless desirable pulsed combustion results.

In a pulse combustion system 10 having two horizontal combustion chambers 12, the chambers 12 may be oriented such that the second endwalls 18 are face-to-face with the air conduits 30 in an oppositely faced and axially aligned position. Such an arrangement provides for reduced sound emissions and for anti-phase self-aspirating operation.

Figure 3:
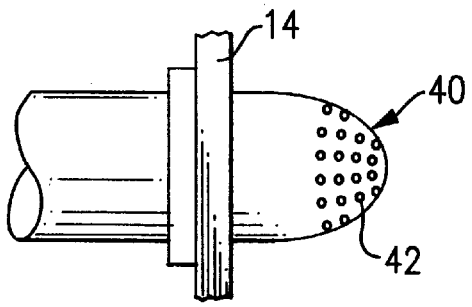
FIG. 3 is a side view of the fuel nozzle of the first preferred embodiment.

Referring now to FIGS. 2 and 3, a fuel nozzle 40 is preferably provided for steady state injection a fuel into the combustion chamber 12. Orifices 42 are defined in the nozzle 40 for permitting the passage of fuel therethrough, with the size, arrangement and density selected based on the amount of fuel desired to be injected into the chamber 12. The fuel nozzle 40 is preferably of a conventional type that is known in the art. The fuel nozzle 40 extends preferably through the first endwall 14, or optionally through the sidewall 18, into the chamber 12. The fuel nozzle 40 may be removably installed by providing a threaded portion (not shown) that engages a mated threaded portion (not shown) of the first endwall 14 or sidewall 18.

The fuel nozzle 40 is spaced apart from the exhaust outlet 25, where the spaced apart relationship is preferably provided by the fuel nozzle 40 being positioned in the first half 22 of the chamber 12. Thus, the air conduit outlet 34, the fuel nozzle 40, and the ignitor 26 are all arranged within the fist half 22 of the combustion chamber 12 such that fuel/air mixing and ignition thereof also occurs generally in the chamber first half 22. This provides a point of combustion within the chamber 12 that is generally off-center and remote from the exhaust outlet 25, allowing the ignited mixture to expand and bum to completion as the coaxial chamber 12 and air conduit 30 arrangement induce a helical swirl of the burning mixture about the air conduit 30 and along the length of the chamber 12 toward the exhaust outlet 25. It should be noted the positional interrelationship between the air conduit outlet 34, the fuel nozzle 40, and the ignitor 26 within the chamber first half is not critical.

Figure 4:
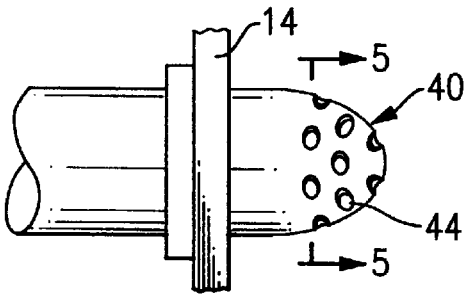
FIG. 4 is a side view of an alternate fuel nozzle of the first preferred embodiment.
Figure 5:
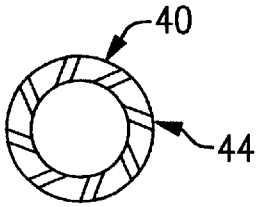
FIG. 5 is a section view of the alternate fuel nozzle taken at line 5—5 of FIG. 4.

Different nozzles 40 each having different sized and arranged orifices 42 may be interchangeably used with the pulse combustion system 10. The combustion system 10 may thereby utilize a variety of different gas and liquid fuels, including natural gas, liquid propane, oil and the like. Thus, a nozzle 40 having larger orifices 42 may used for providing a dispersion of a gas fuel, and then the combustion system 10 may be converted to burning a liquid fuel such as oil simply by installing a nozzle 40 having smaller orifices 42 with no other significant adjustment required to convert the combustion system 10 amongst various conventional fuels. The combustion system 10 may achieve similar resulting thermal and acoustic pulse waves with gas and liquid fuel, though a liquid fuel may tend to take longer to fully combust than a gas fuel in the same combustion chamber 12. Referring to FIGS. 4 and 5, the fuel nozzle 40 may alternatively be provided with angled orifices 44, preferably arranged with an axis thereof at an angle relative to a longitudinal and/or radial axis of the combustion chamber 12. The angled orifices 44 provide for injecting fuel into the chamber 12 at a rotary angle to induce a rotary flow of the fuel/air mixture in the chamber 12 and thereby promote the helical swirl of the burning mixture about the air conduit 30.

Figure 6:
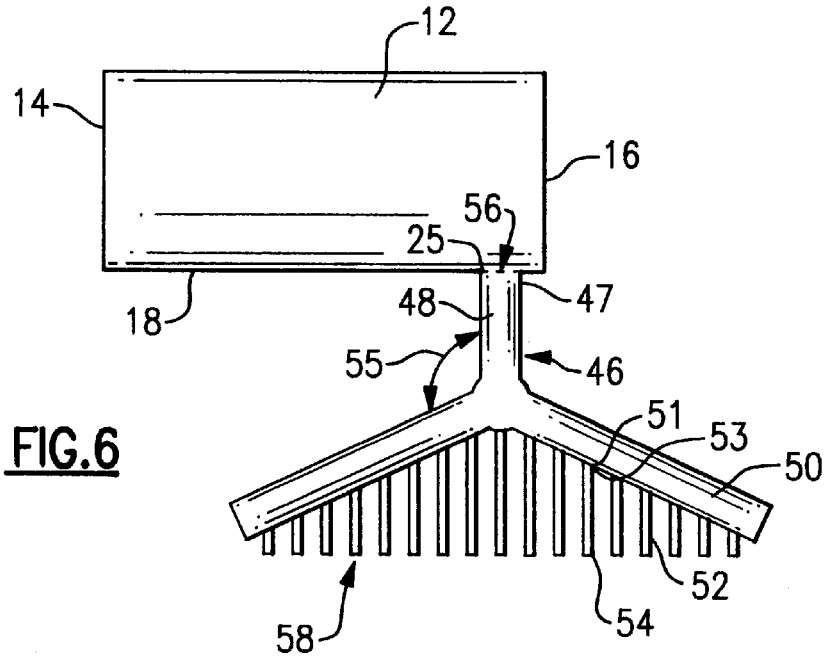
FIG. 6 is a side view of the combustion chamber and exhaust manifold of the first preferred embodiment.
Figure 8:
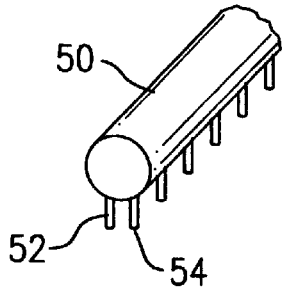
FIG. 8 is a detail perspective view of the secondary exhaust pipes of the exhaust manifold.
Figure 7:
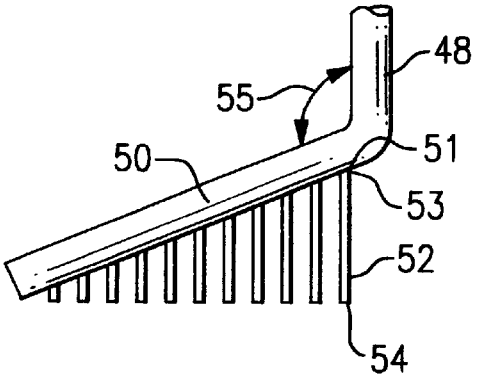
FIG. 7 is a side view of an alternate exhaust manifold arrangement of the first preferred embodiment.

Turning now to the exhaust of the burnt fuel/air mixture, i.e., the hot exhaust gases, from the combustion chamber 12, and referring to FIGS. 6–8, there is preferably provided an exhaust manifold 46 for exhausting the hot exhaust gasses from the chamber 12. The exhaust manifold 46 preferably has a resonant primary exhaust pipe 48 with a first end 47 tangentially attached to the combustion chamber 12 at the exhaust outlet 25. Such a tangential exhaust arrangement is particularly desirable when utilized in conjunction with the heretofore described combustion chamber because the tangentially arranged primary exhaust pipe 48 advantageously receives the helically swirling exhaust gasses without impeding the thermal and acoustic pulse waves associated therewith, thereby efficiently delivering the gas and pulse waves into the exhaust manifold 46.

As described heretofore, the exhaust outlet 25 is arranged in a position generally adjacent the chamber second endwall 16 and is thus positioned generally offcenter and remote from the point of combustion. This arrangement allows the ignited fuel/air mixture to fully combust as it helically swirls along the length of the chamber 12, and to set up and fully develop the associated thermal and acoustic waves prior to exhaustion from the chamber 12. This arrangement thereby provides for increased thermal efficiency of the combustion process and also limits any backflow of the exhaust gases during a subsequent air intake cycle.

It is preferable to provide the primary exhaust pipe 48 of a high temperature resistant metal alloy such as stinless steel, though other high temperature resistant materials such as ceramics, synthetics or like may be employed as is known by those skilled in the art The primary exhaust pipe 48 may include one or more pipe angle portions 49 (best shown in FIGS. 1, 9 and 11), such as elbows or the like, for arranging the primary pipe 48 in the desired direction. Any such angle portions are preferably minimal in number and without acute angles.

The primary exhaust pipe 48 preferably includes a distribution member portion 50 having a plurality of spaced apart orifices 51 defined therein. The distribution member 50 allows propagation of the exhaust gases therethrough for a smooth dispersion over a wide area, without impeding the associated thermal and acoustic pulse waves. The distribution member 50 may be arranged at an angle 55 relative to the primary pipe 48 in order to achieve the desired dispersion area, which exact angle degree is not critical as long as it is not acute. The distribution member 50 may be provided in the shape of an inverted V, as shown in FIG. 6. Optionally, the distribution member 50 may be provided as a single length of angled pipe, as shown in FIG. 7, or in like angled configurations.

A plurality of secondary exhaust pipes 52 are provided, each having an inlet end 53 and an outlet end 54. Each inlet end 53 is attached to and extends from the distribution member 50, and is in alignment with one of the orifices 51. The outlet ends 54 direct the exhaust gases toward a material. The secondary exhaust pipes 52 may be substantially collateral and the outlet ends 54 may be substantially coplanar, though the pipes 52 may be provided in any regular or irregular arrangement as may be desired in a given application. At least one row of secondary pipes 52 is preferably provided, such as the two rows of secondary pipes 52 shown in FIG. 8, though any number rows may be provided as allowed by the size of the primary pipe 48 and based on the desired distribution area of and heat delivered from the directed exhaust gases. Where more than one row of secondary pipes 52 are provided, the rows may be staggered to provide for a uniform distribution area of exhaust gases. Optionally, the diameter, spacing, and uniformity of the secondary pipes 52 may be provided in other arrangements selected based on the desired distribution area of and heat delivered from the exhaust gases.

The primary pipe 48 and secondary pipes 52 preferably have a circular cross-section, though oval or the like cross-sectional shapes may be employed. In order to achieve the optimal efficient propagation of the pulse waves through the manifold 46, the primary exhaust pipe 48 has a cross-sectional inlet area 56, and the secondary exhaust pipes 52 have a cumulative cross-sectional outlet area 58 that is about equal to or greater than the primary exhaust pipe cross-sectional inlet area 56, but no more than about 20 percent greater than same area 56, and more preferably, less than about 10 percent. It should be noted that other relationships between the cross-sectional inlet area 56 and the cumulative cross-sectional outlet area 58 may be provided with lesser but nevertheless desirable benefits.

Figure 9:
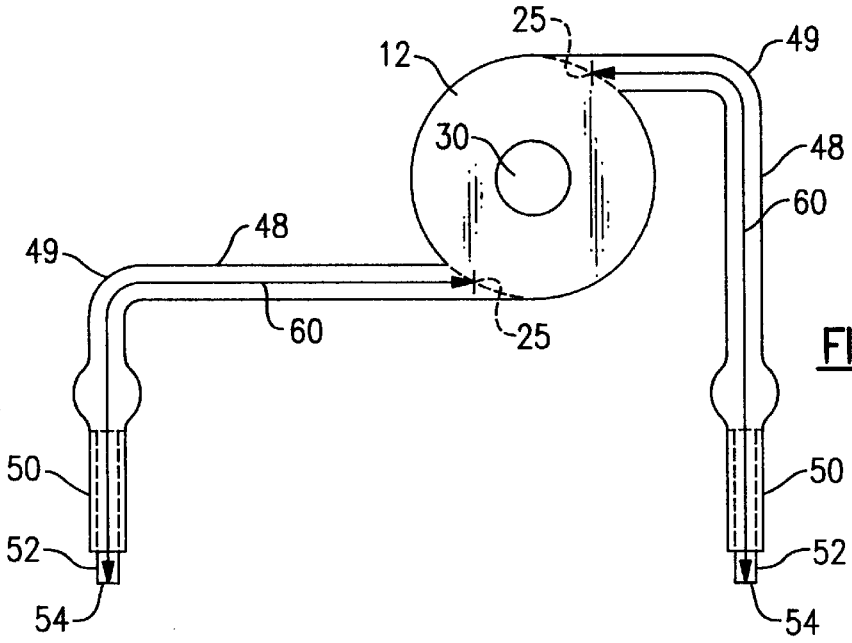
FIG. 9 is an end view of the combustion chamber and exhaust manifold of the first preferred embodiment.
Figure 10:
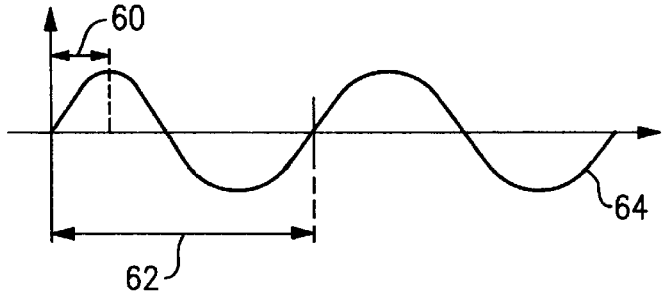
FIG. 10 is an amplitude-time plot of an acoustic wave of the first preferred embodiment.
Figure 11:
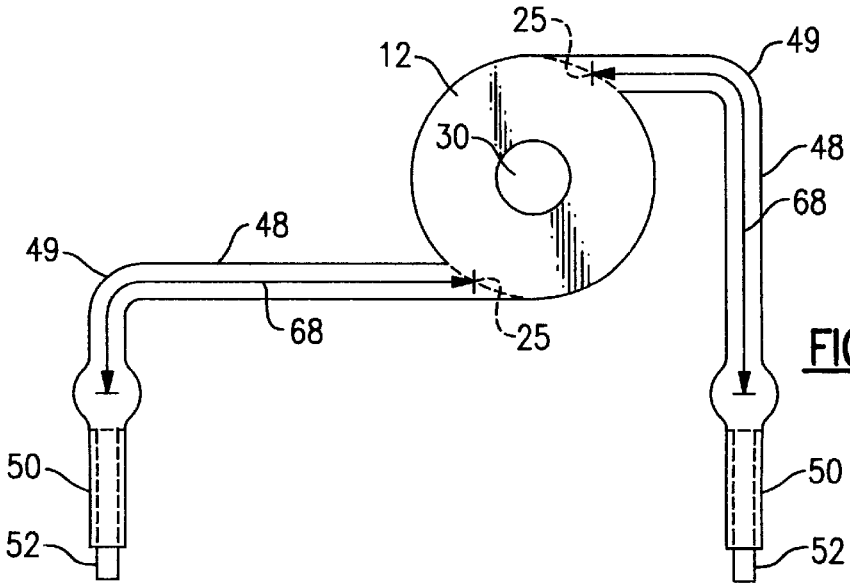
FIG. 11 is an end view of the combustion chamber and exhaust manifold of the first preferred embodiment.

Referring to FIGS. 9–11, in order to further achieve the desired efficient resonant harmonic propagation of the pulse waves through the manifold 46, the exhaust manifold 46 is preferably provided with specific lengths of primary and secondary piping 48, 52. For example, it is preferable for the total average length 60 of the exhaust manifold 46, which is defined as the length from the exhaust outlet 25 through the primary pipe 48 to the outlet end 54 of an average length secondary pipe 53 (see FIG. 9) to be generally about one quarter of a wavelength 62 of an acoustic pulse wave 64 (see FIG. 10) generated by the pulse combustion system 10. Furthermore, it is preferable for the primary pipe 48 to have a length 68, defined between the combustion chamber outlet 25 and the distribution member 50, that is generally about two-thirds of the average total exhaust pipe length 60.

Where the system 10 comprises a horizontally oriented combustion chamber 12 with multiple exhaust manifolds 46, the primary pipe 48 may need to be asymmetrically arrangement with the chamber not centrally positioned therebetween in order to accomplish the preferred lengths 60, 68, as shown in FIGS. 9 and 11. It should be noted that these dimensional criteria are suggested to provide optimal harmonic resonance and thus to propagate the pulse waves through the manifold with a minimum of impedance, but deviations therefrom may produce lesser though nevertheless desirable results.

Referring back to FIG. 1, an enclosure 70 may be provided for housing the combustion chamber 12 and exhaust manifold 46, and is preferable for conveyor-type processes. The combustion system 10 when disposed within an enclosure 70 may thus be provided as a modular unit, with the number and size of modular units selected based on the desired heat output and the distribution area over which the heat output is desired to be applied. The size and shape of the enclosure 70 is selected to accommodate the number and size of chambers 12 provided in a particular combustion system 10 and as well as the number and size of exhaust manifolds 46 provided per chamber 12. The enclosure 70 is preferably made of a rigid material such as a metal or composite using fabrication techniques known to those skilled in the art.

Turning now to temperature control of the pulse combustion system 10, and referring generally to FIGS. 12–17, there is preferably provided a generally rectangular enclosure 70 having four sidewalls 72 and two endwalls 74. A layer of insulation material 75 may be provided, such as fiberglass, a ceramic material, or a like non-flammable material with good insulation properties. The insulation layer 75 may line the enclosure 70 to substantially retain within the enclosure 70 the heat and noise generated by the combustion system 10.

Figure 12:
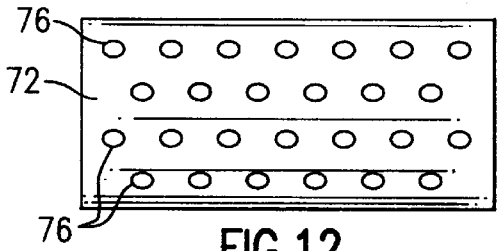
FIG. 12 is a plan view of a sidewall of an enclosure of the first preferred embodiment.

As shown in FIG. 12, at least one sidewall 72 has a plurality of apertures 76 defined therein in accordance with the number, shape, size, and location of the outlet ends 54 of the secondary exhaust pipes 52, such that air is substantially sealed within the enclosure 70. The apertures 76 may be defined in a single bottom sidewall, in two opposing sidewalls, or in other configurations as may be beneficial in a given application.

Figure 13:
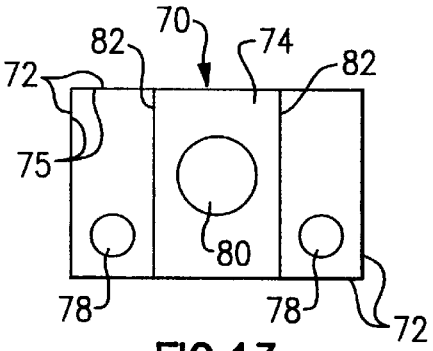
FIG. 13 is an end view of an endwall of the enclosure of the first preferred embodiment.
Figure 14:
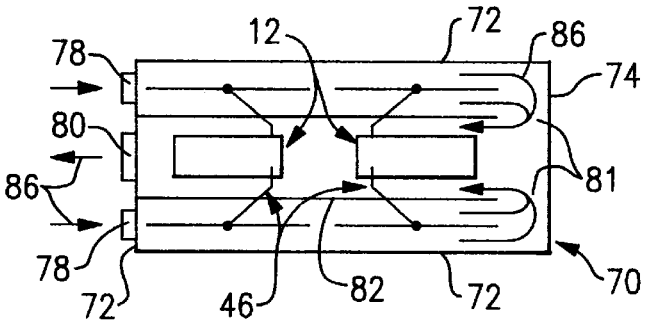
FIG. 14 is a plan view of the enclosure of the first preferred embodiment.

As shown in FIGS. 13–14, at least one endwall 74 has at least one air inlet 78 defined therein, with the number of air inlets 74 generally selected based on the number of aligned sets of exhaust manifolds 46. At least one air outlet 80 is provided, preferably defined in the same endwall 74 as the air inlet 78. At least one partition 82 is preferably provided within the enclosure 70, and is coextensive with the vertical sidewalls 72 of the enclosure 70 except longitudinally where an opening 81 is provided adjacent an endwall 74 opposite from the air inlet 78 and outlet 80. The partition 82 thereby compartmentalizes the enclosure to block the lateral movement of air within the enclosure 70 except through the airflow passageway formed by opening 81. Any air entered through the air inlet 78 is thereby directed to flow across at least a part of the exhaust manifold 46, through the opening 81, across the combustion chamber 12, and out of the enclosure 70 through the air outlet 80.

Figure 15:
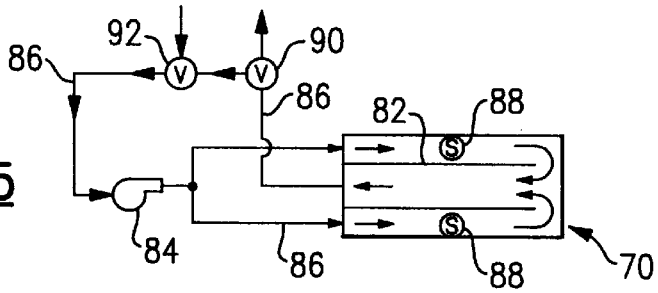
FIG. 15 is a schematic of directed airflow for temperature control of the first preferred embodiment.

Referring now to FIG. 15, a blower 84 or other positive pressure creating device may be connected to the air inlet 78 by ductwork or the like for forcing cooling air into the enclosure 70 in an airflow direction 86. Temperature control of the exhaust gas and the heretofore described components of the combustion system 10 may thereby be provided by adjusting the volume flow rate of air from the blower 84 into the enclosure 70 and across the exhaust manifold 46 and combustion chamber 12. One or more conventional temperature sensors 88 and control wiring as known in the art may be positioned within or without the enclosure 70 at various locations as desired for providing temperature feedback and control for adjusting the blower 84. Also, a valve 90 or the like may be provided for redirecting a portion of the heated air out to another application or use, and a valve 92 or the like may be provided for redirecting heated air from another application into the enclosure air inlet 78 as preheated air.

Figure 16:
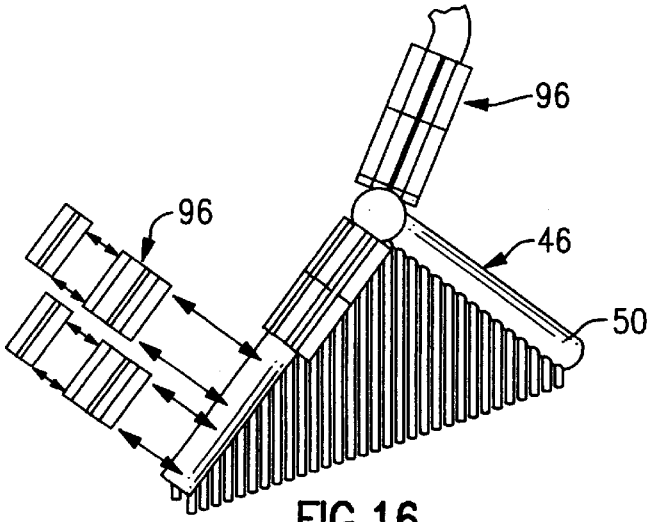
FIG. 16 is a perspective view of temperature control fins of the first preferred embodiment.
Figure 17:
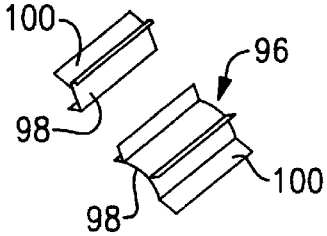
FIG. 17 is a detail perspective view of a fin of the first preferred embodiment.

Referring now to FIGS. 16–17, additional temperature control may be provided by at least one heat exchanger fin 96 removably coupled to the primary exhaust pipe 48 (which includes the distribution member 50). Any number of fins 96 may be provided as desired for temperature control and limited by the length of the primary pipe 48. The fins 96 preferably have a concave curved portion 98 for receiving the tubular exhaust pipe 48, and extended surfaces 100 therefrom providing an increased surface area for increased heat transfer. The removable couplings are preferably provided by conventional clamps or the like. It is desirable that the fins 96 be made of material having a greater thermal conductivity than the material of the primary pipe 48. For example, the fins 96 may be provided of copper or aluminum where the primary pipe 48 is of stainless steel.

The combustion system 10 preferably includes for temperature control both the fins 96 and the enclosure 70 as described heretofore. Optionally, only the fins 96 or only the enclosure 70 may be provided. The enclosure 70 may be provided with a sidewall 72 that is removable for access to the fins 96 for removing or adding fins 96 as determined by the temperature requirements of a given application.

It should be noted that while the pulse combustion system 10 as described herein provides a manifold for directing the heat output toward a material in a conveyor-type application, the system 10 may be suitably provided in various other forms thereof. For example, the primary exhaust pipe 48 may optionally act as a heat exchanger for heat transfer to a fluid such as oil or water in which the exhaust pipe is immersed. Also, a single primary exhaust pipe 48 may direct the heat output toward a material without the use of a secondary exhaust pipe network, for example, in applications where it is desired to provide a focused high intensity heat output.

Figure 18:
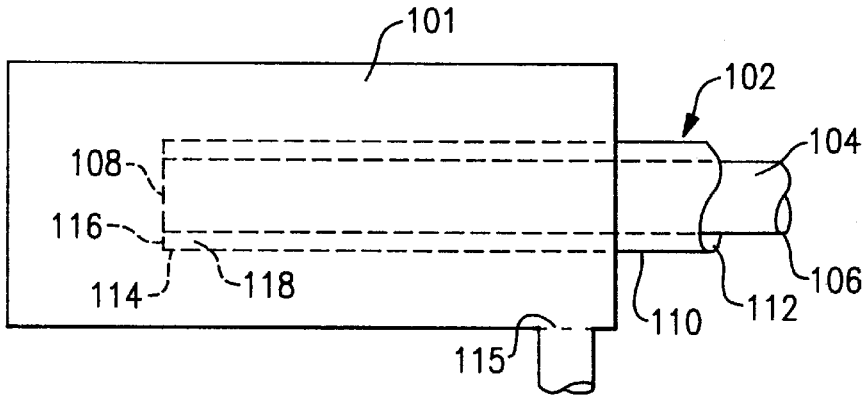
FIG. 18 is a side view of a combustion chamber of a second preferred embodiment of the present invention.

Referring now to FIG. 18, a second embodiment of the present pulse combustion system 103 comprises the pulse combustion system 10 described heretofore except having a modified introduction of fuel and air into a combustion chamber 101. In this embodiment, a coaxial fuel/air conduit 102 extends coaxially into the chamber 101. The coaxial fuel/air conduit 102 comprises a generally tubular air conduit 104 having an air inlet end 106 and an air outlet end 108, and a generally tubular fuel conduit 110 having an fuel inlet end 112 and an air outlet end 114. The fuel conduit 110 is generally concentrically disposed about the air conduit 104 such that the fuel conduit 110 and the air conduit 104 are radially spaced a sufficient amount to allow the passage therethrough of a desired flow of fuel. The fuel/air conduit 102 extends coaxially into the combustion chamber 101 such that the air outlet end 108 and the fuel outlet end 114 are spaced apart from an exhaust outlet 115 of the combustion chamber 101, similar to the first embodiment as described heretofore.

Figure 20:
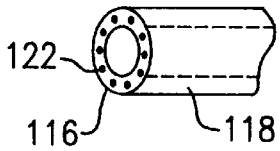
FIG. 20 is a detail perspective view of an alternate fuel nozzle of the second preferred embodiment.
Figure 19:
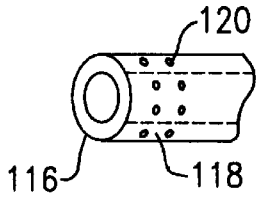
FIG. 19 is a detail perspective view of a fuel nozzle of the second preferred embodiment.

Referring now to FIGS. 19 and 20, there are illustrated various arrangements of the fuel/air conduit 102 for introducing fuel into the chamber 12. Generally, the fuel outlet end 114 of the fuel conduit 110 has an endwall 116 and a curved sidewall 118. As shown in FIG. 18, a plurality of orifices 120 are preferably provided in the curved sidewall 118 generally adjacent the endwall 116 for injecting fuel generally radially into the chamber 12. Optionally, as shown in FIG. 19, a plurality of orifices 122 may be provided in the endwall 116, for injecting fuel generally longitudinally into the chamber 12. It should be noted that both endwall and sidewall orifices 120, 122 may be combined into a single fuel/air conduit 102, and additionally, any of these arrangements may be provided with the orifices 120, 122 angled relative to a longitudinal and/or radial axis of the elongated combustion chamber to induce a rotary flow of fuel therethrough to promote the helical swirl of the expanding, burning fuel/air mixture about and along the fuel/air conduit 102, similar to the first embodiment described heretofore. Also, the orifices 120, 122 may be provided with sizes, shapes, spacing, density, and uniformity selected primarily based on the fuel type and rate desired to be used.

Figure 21:
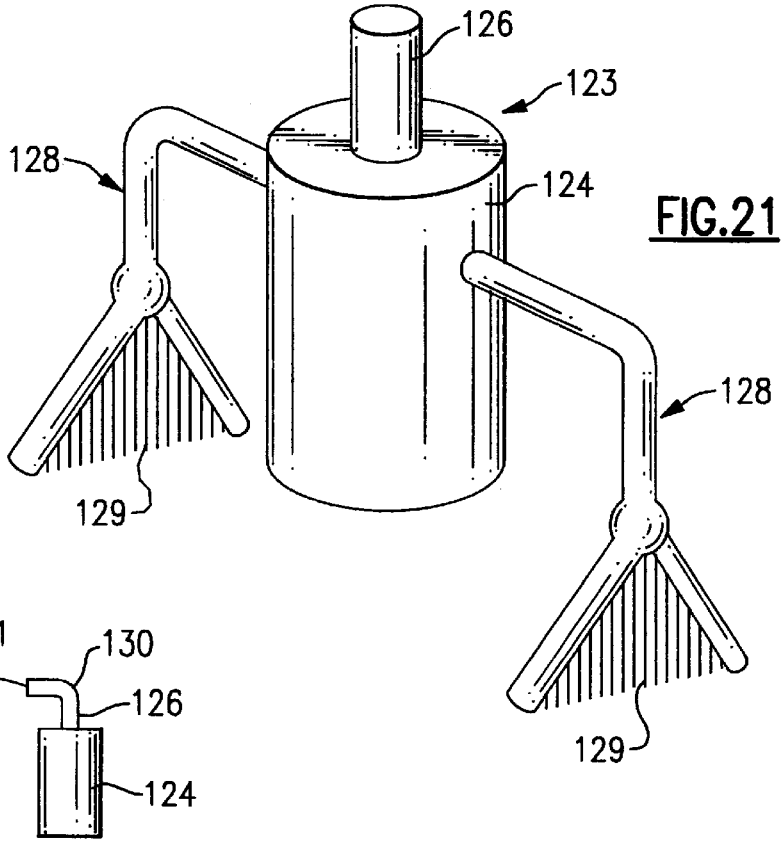
FIG. 21 is a perspective view of a combustion chamber and exhaust manifold of a third preferred embodiment of the present invention.

Referring now to FIG. 21, a third embodiment of the present pulse combustion system 123 comprises the combustion system 10 of the first embodiment except having a modified combustion chamber 124 incorporated into the system 10. The combustion chamber 124 is generally arranged in a vertical or upright position, with a coaxial air conduit 126 extending generally upward or downward from the chamber 124. Any number of exhaust manifolds 128 may be provided, preferably having the secondary exhaust pipes 129 generally collateral thereto. The exhaust manifolds 128 are thus generally equidistant from and symmetrical about the chamber 124, an arrangement generally not be available with the horizontal combustion chamber 12 of the first embodiment. A greater number of combustion chambers 124 may be included in the modular unit because the lateral space required per chamber 124 is reduced, thereby providing for an increased total and/or intensity of heat output as may be desired in a given application.

Figure 22:
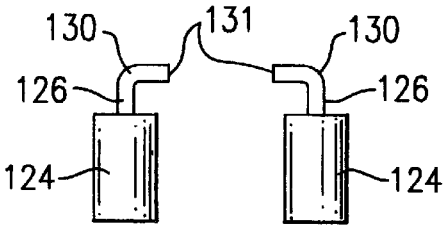
FIG. 22 is a side view of an alternate combustion chamber arrangement of the third preferred embodiment.

Referring to FIG. 22, in the case where a system 10 or 123 is provided with two vertical or upright chambers 124, the air conduits 126 may optionally have an angled portion 130 such that inlet ends 131 of the air conduits 126 are oppositely faced and axially aligned. Such an arrangement may provide for an anti-phase self-aspirating operation, as described heretofore in the first embodiment.

Figure 23:
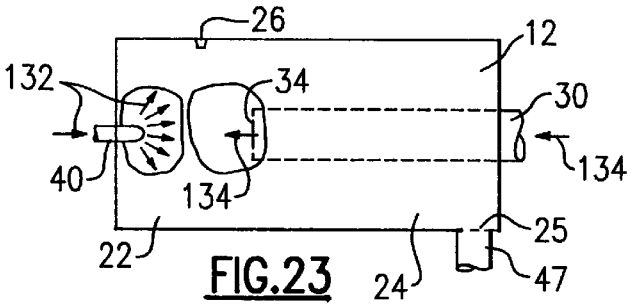
FIGS. 23–29 are side and end views of the operational sequence of the combustion chamber of the first preferred embodiment.
Figure 24:
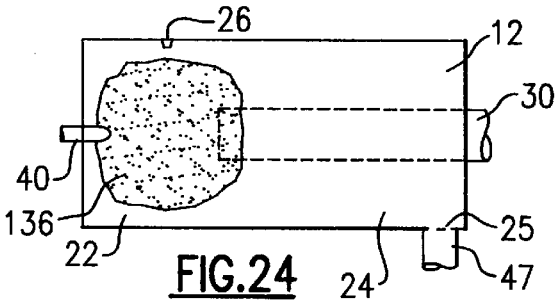
Figure 25:
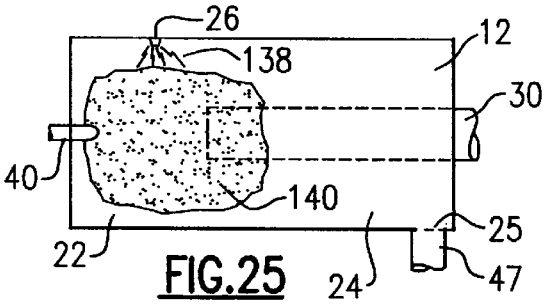
Figure 26:
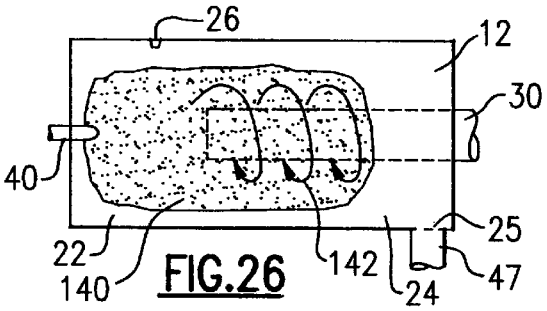
Figure 27:
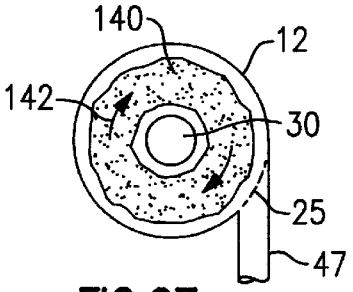

The operation of the pulse combustion system 10 will now be described in detail, with reference to FIGS. 23–32 and the component parts described heretofore. As shown in FIG. 23, fuel 132 is injected into the combustion chamber 12 through the fuel nozzle 40 and combustion air 134 is introduced into the chamber 12 through the air conduit 30. As shown in FIG. 24, the fuel 132 and combustion air 134 mix in the first half 22 of the chamber 12 to form a fuel/air mixture 136. As shown in FIG. 25, the fuel/air mixture 136 is detonated by a spark 138 from the spark plug ignitor 26 (or flame from a pilot ignitor) producing a burning fuel/air mixture 140 having an associated thermal and acoustic wave. As shown in FIG. 25, the burning fuel/air mixture 140 expands in a pulse along the length of the chamber 12, with the cylindrical shape of the chamber 12 and the coaxial air conduit 30 inducing a helical swirl 142 about the conduit 30. As shown in FIGS. 26 and 27, the burning fuel/air mixture 140 expands along the length of the chamber 12 in a toward the exhaust outlet 25.

The air conduit outlet 34 and the fuel nozzle 40 are arranged within the first half 22 of the combustion chamber 12 such that mixing of the fuel 132 and combustion air 134, and the ignition thereof, occur generally in the chamber first half 22. This results in a point of combustion within the chamber 12 that is generally off-center and remote from the exhaust outlet 25, providing the opportunity for the mixture 140 to fully burn and generally complete the combustion thereof within the combustion chamber 12. The process as described thereby extracts substantially all the available energy content of the fuel 132 prior to exhausting the mixture 140 from the chamber 12 for increased thermal efficiency of the combustion system 10.

Additionally, the thermal and acoustic pulse waves associated with the exploding mixture 140 provide turbulence which promotes a more complete mixing of the fuel 132 and combustion air 134, and which results in a more complete combustion of the fuel/air mixture 136 for increased thermal efficiency. The elongated combustion chamber 12 further provides the opportunity to set up and fully develop high velocity, high amplitude thermal and acoustic pulse waves, the advantage of which will be further addressed hereinafter.

For startup of the combustion system 10, the combustion air 134 is provided to the chamber 12 by the blower 84 forcing cooling air 150 into the enclosure 70 through the cooling air inlet 72. Because the air conduit 30 is free of constrictions such as valves, a portion of the cooling air 150 is forced through the air conduit 30 into the chamber 12. It should be noted that the flow rate of the cooling air 150 is not critical as long as at least some air is introduced into the chamber 12 for combustion.

After startup of the combustion system 10, that is, after a few pulsed combustion cycles, the pressure reversals of the pulsating combustion achieve a sufficient magnitude such that the combustion process becomes self-aspirating, with combustion air 150 being drawn into the chamber 12 upon the pressure drop therein resulting from exhaust of the fully expanded and burnt fuel/air mire 136. In an arrangement having two chambers 12 with oppositely faced and axially aligned air conduit inlets 32, the combustion pulses will achieve an equilibrium anti-phase state, that is, with the pulse waves at a phase difference of 180 degrees, for more spontaneous acoustic pulsations and a smoother combustion to reduce sound emissions from the chamber 12 to the environment.

Figure 28:
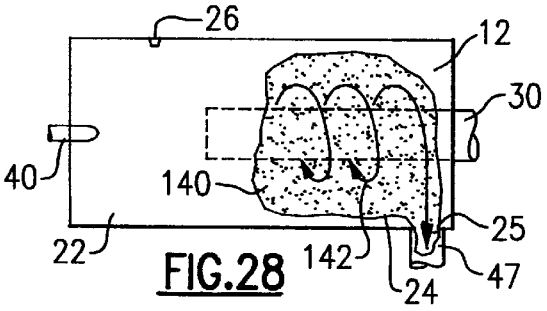
Figure 29:
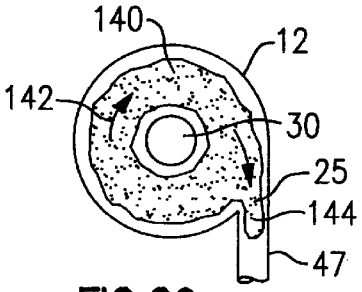

Referring still to FIGS. 28 and 29, the exhaust pipe end 47 extends tangentially from the combustion chamber 12 at the exhaust outlet 25. As the helically swirling burning mixture 140 approaches the exhaust outlet 25, the mixture will preferably completely burn prior to exhaustion from the chamber 12, with the resulting heated exhaust gas 144 therefore containing thermal energy representing a high percentage of the available energy content of the fuel 132. The tangential exhaust arrangement advantageously receives the helically swirling exhaust gas 144, as the tangential exhaust pipe and the helically swirling exhaust gas 144 have the same rotational direction.

Figure 30:
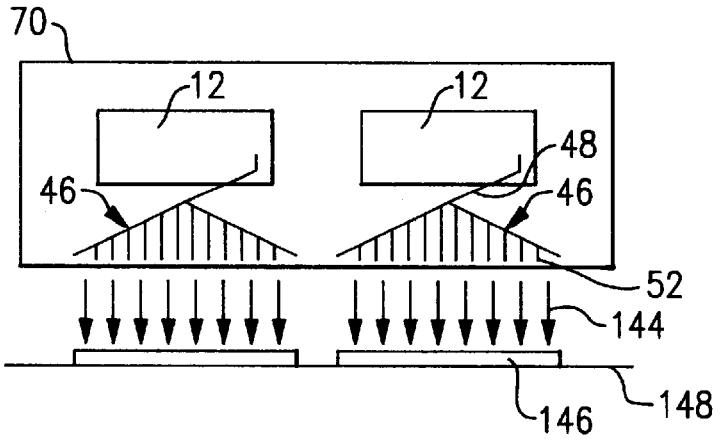
FIG. 30 is a side view of the first preferred embodiment showing its operation in a conveyor-type heat and mass transfer process.
Figure 31:
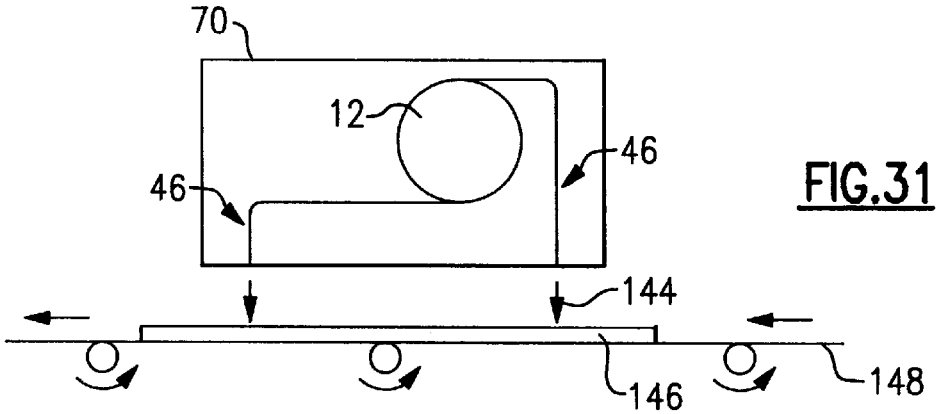
FIG. 31 is an end view of the first preferred embodiment of FIG. 30; and, FIG. 32 is a schematic of directed airflow for temperature control of the first preferred embodiment.

Turning now to the operation of the exhaust manifold 46, and referring to FIGS. 30 and 31, the heated exhaust gases 144 and associated thermal and acoustic pulse waves, having been efficiently exhausted from the combustion chamber 12 by the tangential arrangement of the primary exhaust pipe end 47, are delivered into the primary exhaust pipe 48 of the resonant exhaust manifold 46. Because of the lengths 60, 68, cross-sections 56, 58, and angles 49, 55 selected for the primary and secondary exhaust piping 48, 52, the pulse waves resonantly propagate through the exhaust manifold 46 with minimal impedance and losses therefrom.

The heated exhaust gases 144 are dispersed through the distribution member 50 into the secondary pipes 52 and exhausted therefrom in a direction toward a dispersion area of a material 146 on a conveyor system 148. The resonant propagation of the thermal and acoustic pulse waves from the point of combustion to the point of application to the material 146 provides fully developed, high amplitude, high velocity, reversible thermal and acoustic pulse waves acting on the material 146, thereby breaking down the boundary layer to permit the thermal energy to act more directly on the material 146. Such boundary layer breakdown allows for a greater heat and mass transfer rate and as a consequence produces an increased thermal efficiency.

Figure 32:
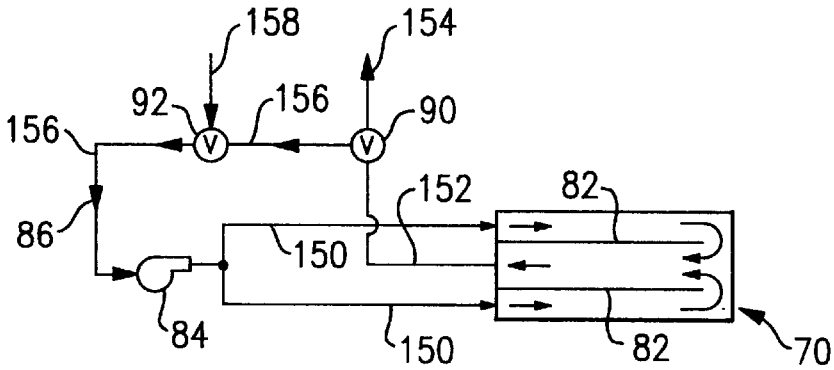

Turning now to the operation of the temperature control components, and referring to FIG. 32, temperature control of the exhaust gas 144 and the components of the combustion system 10 may be provided by adjusting the volume flow rate of cooling inlet air 150 into the enclosure 70 and across the exhaust manifold 46 and combustion chamber 12. An increased volume flow rate of cooling inlet air 150 provides increased heat transfer from the manifold 46 to the cooling inlet air 150 to reduce the temperature of the exhaust gases 144. An increased volume flow rate of cooling inlet air 150 also provides cooling of the combustion chamber 12 and exhaust manifold 46 to prevent overheating and premature failure therefrom. The flow rate of cooling inlet air 150 is adjusted by the blower 84, which adjustments are made based on temperature feedback from the temperature sensors 88.

The temperature control features described also provide increased thermal efficiency of the system 10 by recovering and utilizing waste heat from the cooling process described above. The cooling inlet air 150 from the blower 84 becomes heated by passing across the heated exhaust manifold 46, and a portion of the heated air is drawn into the combustion chamber 12 through the air conduit 30 during each air intake cycle of the pulsating combustion process, thereby providing pre-heated air for combustion. The remaining heated air exits the enclosure 70 through the air outlet 80 as output air 152, and all or a portion thereof may be directed back to the blower 84 as recirculated air 156. The valve 90 may be provided for redirecting a portion of the heated output air 152 to another application or use as redirected air 154. Also, the valve 92 may be provided for redirecting heated air 158 from other applications into the air input 150 stream for additional preheating of inlet air 150.

Additional temperature control may be achieved by adding or removing the heat transfer fins 96. In practice, the number and/or size of fins 96 is determined based on the specifications and system configuration for a given application, and then temperature control during operation of the system 10 is made by adjusting the volume and/or direction of airflow from the blower 84.

It should be noted that for optimal performance the features described as the preferred embodiments herein are provided combined into the pulse combustion system 10. It may also be desirable to provide the combustion chamber 12 for setting up and developing the helical swirl 142 of the burning mixture 140 with other exhaust arrangements. It may further be desirable to provide the tangential exhaust pipe 47 for a swirling mixture 140 set up by another type combustion chamber and delivered into another type exhaust system. The combustion chamber 12 and tangential exhaust pipe 47 may also be effectively utilized in an application for exchanging heat with a fluid, for example, in a hot water heater type application. Moreover, it may be desirable to provide the exhaust manifold 46 incorporated into another type combustion system.

For installation of the pulse combustion system 10, the modular system 10 may be mounted by brackets or the like attached to the enclosure 70. The modular system 10 may be mounted in any orientation as may be required by a given application. Any number of modular units may be provided, with the number and size of modular systems 10 selected based on the desired heat output and the distribution area over which the heat output is desired to be applied. It should be noted that, in contrast to many known combustion systems for conveyor type heat transfer processes, the enclosure 70 of the present invention is not an oven where material to be treated passes therethough, but rather is a modular unit that may be oriented in a wide variety of arrangements to direct heat in a desired direction over a desired dispersion area.

Accordingly, there are a number of advantages provided by the present invention. The present pulse combustion system 10 for heat and mass transfer processes provides a design that is modular, simple and cost-effective to manufacture and use for a variety of different applications. The system 10 produces a high thermal efficiency and is self-aspirating.

The present pulse combustion system 10 additionally provides a combustion chamber 12 with an off-center point of combustion that sets up a helical swirl 142 of burning fuel/air mixture 140 along an axial length of the combustion chamber 12, and fully develops high turbulence, high velocity thermal and acoustic pulse waves associated with the exploding mixture 140.

The present pulse combustion system 10 further provides an exhaust manifold 46 with at least one primary exhaust pipe 48 tangentially attached to the combustion chamber 12 for exhausting the burnt gases 144 from the chamber 12 without impeding the associated thermal and acoustic pulse waves.

The present pulse combustion system 10 still further provides an exhaust manifold 46 having a plurality of secondary exhaust pipes 52 extending from the primary exhaust pipe 48 for propagating without impeding the thermal and acoustic pulse waves therethrough, and for directing and applying the thermal and acoustic pulse waves to a material 146.

The present pulse combustion system 10 additionally provides a plurality of thermal conductive fins 96 removably coupled to the primary exhaust pipe 48, an enclosure 70 with partitions 82 therein forming passageways for airflow therethrough, and a blower 84 for directing air into the enclosure 70 for temperature control of the combustion system 10.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A pulse combustion system, comprising:

a) at least one elongated combustion chamber having at least one endwall, at least one sidewall with a length, and an exhaust outlet defined in said sidewall at a position generally proximate to said endwall;

b) at least one exhaust pipe having a first end extending from said combustion chamber and in alignment with said exhaust outlet;

c) at least one air conduit extending coaxially through said endwall of said combustion chamber and extending coaxially into said combustion chamber, said air conduit having an outlet end disposed within said combustion chamber such that said exhaust outlet is between said endwall and said air conduit outlet;

d) at least one fuel nozzle extending into said combustion chamber and disposed within said combustion chamber such that said exhaust outlet is between said endwall and said fuel nozzle; and e) at least one igniter associated with said combustion chamber, wherein fuel is entered into said combustion chamber through said fuel nozzle, air is entered into said combustion chamber through said air conduit and mixes with said fuel to form a fuel/air mixture, said fuel/air mixture is ignited by said igniter to form a burning fuel/air mixture and generate a thermal and an acoustic pulse wave, said burning mixture expands in a helical swirl about said air conduit and along said length of said combustion chamber, said burning mixture combusts to produce exhaust gas, and said burning mixture or exhaust gas exhausts from said combustion chamber through said exhaust pipe.

2. The pulse combustion system of claim 1, wherein said elongated combustion chamber is generally cylindrical.

3. The pulse combustion system of claim 1, wherein said combustion chamber has a curved portion, said exhaust outlet is positioned on said curved portion, and said exhaust pipe extends tangentially from said curved portion.

4. The pulse combustion system of claim 3, wherein said fuel nozzle has a plurality of orifices defined therein at an angle relative to a longitudinal or radial axis of said elongated combustion chamber such that said angled fuel nozzle orifices induce a flow of said fuel/air mixture in a rotary direction, and wherein said tangential exhaust pipe extends from said combustion chamber in said rotary direction to accept said rotary flow of said burning mixture.

5. The pulse combustion system of claim 1, wherein said exhaust pipe comprises a manifold having at least one primary exhaust pipe and a plurality of secondary exhaust pipes extending from said primary exhaust pipe.

6. The pulse combustion system of claim 1, wherein said combustion chamber comprises a first section partially defined by said sidewall and a second section partially defined by said sidewall and said endwall, said fuel nozzle and said air conduit outlet are disposed within said first section, said exhaust outlet is disposed within said second section, and said air conduit extends through said second section.

7. The pulse combustion system of claim 5, wherein said first section and said second section of said combustion chamber each comprise a space that is substantially half of said combustion chamber.

8. The pulse combustion system of claim 1, wherein said air conduit outlet end is tapered inward and said air conduit has an inlet end that is tapered outward.

9. The pulse combustion system of claim 1, wherein said air conduit allows airflow therethrough free of any movable constrictions to permit air to be drawn into said combustion chamber.

10. The pulse combustion system of claim 1, wherein said fuel nozzle comprises a fuel conduit concentrically disposed about said air conduit, extending through said combustion chamber endwall, and extending into said combustion chamber.

11. The pulse combustion system of claim 10, wherein said fuel conduit has an endwall with a plurality of orifices defined therein at an angle relative to a longitudinal axis of said elongated combustion chamber.

12. The pulse combustion system of claim 10, wherein said fuel conduit has an endwall and a curved surface with a portion adjacent said endwall, said curved surface portion having a plurality of orifices defined therein at an angle relative to a radial axis of said fuel conduit.

13. The pulse combustion system of claim 1, further comprising at least one heat exchanger fin removably coupled to said exhaust pipe.

14. The pulse combustion system of claim 1, further comprising an enclosure disposed about at least a portion of said combustion chamber and said exhaust pipe.

15. The pulse combustion system of claim 14, wherein said enclosure has at least one cooling air inlet and at least one cooling air outlet, and further comprising a blower associated with said cooling air inlet.

16. The pulse combustion system of claim 1, wherein two combustion chambers are provided with said inlet end of said air conduit of a first chamber in communication with said inlet end of said air conduit of a second chamber.

17. The pulse combustion system of claim 16, wherein said two combustion chambers are arranged in a generally horizontal arrangement such that said air conduits are oppositely faced and axially aligned.

18. The pulse combustion system of claim 16, wherein said two combustion chambers are provided in a generally vertical arrangement.

19. A pulse combustion system for directing heat toward a material, comprising:

a) at least one combustion chamber having an exhaust outlet defined therein;

b) at least one resonant exhaust manifold having at least one primary exhaust pipe extending from said combustion chamber and in alignment with said exhaust outlet, and having a plurality of secondary exhaust pipes extending from said primary exhaust pipe, said secondary exhaust pipes each having an outlet end directed toward said material, primary exhaust pipe having a cross-sectional inlet area and said secondary exhaust pipes have a cumulative cross-sectional outlet area that is about equal to or greater than the primary exhaust pipe cross-sectional inlet area, but no more than about 20 percent greater than the primary exhaust pipe cross-sectional inlet area;

c) at least one air conduit extending into said combustion chamber and allowing free airflow therethrough;

d) at least one fuel nozzle extending into said combustion chamber; and e) at least one igniter associated with said combustion chamber, wherein fuel is entered into said combustion chamber through said fuel nozzle, air is entered into said combustion chamber through said air conduit and mixes with said fuel to form a fuel/air mixture, said fuel/air mixture is ignited by said igniter to form a burning fuel/air mixture and generate a thermal and an acoustic pulse wave, said burning mixture expands within said combustion chamber, said burning mixture combusts to produce exhaust gas, said burning mixture or exhaust gas exhausts from said combustion chamber through said primary exhaust pipe, said burning mixture or exhaust gas propagates through said primary and said secondary exhaust pipes, and said exhaust gas exhausts from said outlet ends of said secondary pipes and toward said material.

20. The pulse combustion system of claim 19, wherein said combustion chamber has a curved portion and said primary exhaust pipe extends tangentially from said curved portion.

21. The pulse combustion system of claim 19, wherein said primary exhaust pipe has at least one distribution member, and said secondary pipes extend from said distribution member.

22. The pulse combustion system of claim 21, wherein said distribution member generally has the shape of an inverted "V".

23. The pulse combustion system of claim 19, wherein said secondary exhaust pipes are arranged in at least one row.

24. The pulse combustion system of claim 19, wherein said secondary exhaust pipe outlet ends are substantially coplanar.

25. The pulse combustion system of claim 19, wherein said at least one combustion chamber comprises at least one endwall and at least one sidewall with a length, and said exhaust outlet is defined in said sidewall at a position generally proximate to said endwall, said air conduit has an outlet disposed within said combustion chamber such that said exhaust outlet is between said endwall and said air conduit outlet, and said fuel nozzle is disposed within said combustion chamber such that said exhaust outlet is between said endwall and said fuel nozzle.

26. The pulse combustion system of claim 19, wherein an average total exhaust pipe length is generally one quarter of a length of a sound wave generated by said pulse combustion system.

27. The pulse combustion system of claim 19, wherein said primary pipe has a length between said combustion chamber outlet and said secondary pipe outlets that is generally about two-thirds of an average total exhaust pipe length.

28. The pulse combustion system of claim 19, further comprising at least one heat exchanger fin removably coupled to said primary exhaust pipe.

29. The pulse combustion system of claim 19, further comprising an enclosure generally disposed about said at least a portion of said combustion chamber and said exhaust pipe.

30. The pulse combustion system of claim 29, wherein said enclosure has at least one partition interposed between said combustion chamber and said secondary exhaust pipes, wherein said partition and said enclosure define an air flow passageway across said secondary pipes and at least a part of said primary exhaust pipe.

31. The pulse combustion system of claim 29, wherein said enclosure has at least one cooling air inlet and at least one cooling air outlet, and further comprising a blower associated with said cooling air inlet of said enclosure.

32. The pulse combustion system of claim 19, further comprising a conveyor system adjacent said secondary pipe outlet ends, said conveyor system capable of carrying said material.

33. A pulse combustion system, comprising:

a) at least one generally cylindrical combustion chamber having a length, at least one endwall, at least one curved sidewall, and an exhaust outlet defined in said curved sidewall at a position generally proximate to said endwall;

b) at least one resonant exhaust manifold having at least one primary exhaust pipe having a first end extending from said combustion chamber and in alignment with said exhaust outlet, said primary pipe comprising a distribution member, and said manifold having a plurality of secondary exhaust pipes extending from said distribution member;

c) at least one air conduit extending coaxially through said endwall of said combustion chamber and extending coaxially into said combustion chamber, said air conduit having an outlet end disposed within said combustion chamber such that said exhaust outlet is between said endwall and said air conduit outlet;

d) at least one fuel nozzle extending into said combustion chamber and disposed within said combustion chamber such that said exhaust outlet is between said endwall and said fuel nozzle;

e) at least one igniter associated with said combustion chamber;

f) at least one heat exchanger fin removably coupled to said primary exhaust pipe;

g) an enclosure generally disposed about at least a portion of said combustion chamber and said exhaust pipe, said enclosure having at least one cooling air inlet and at least one cooling air outlet; and h) a blower associated with said cooling air inlet of said enclosure, wherein fuel is entered into said combustion chamber through said fuel nozzle, air is entered into said combustion chamber through said air conduit and mixes with said fuel to form a fuel/air mixture, said fuel/air mixture is ignited by said igniter to form a burning fuel/air mixture and generate a thermal and an acoustic pulse wave, said burning mixture expands in a helical swirl about said air conduit and along said length of said combustion chamber, said burning mixture combusts to produce exhaust gas, and said burning mixture or exhaust gas tangentially exhausts from said combustion chamber through said tangential primary exhaust pipe, said exhaust gas propagates through said primary and said secondary exhaust pipes, and said exhaust gas exhausts from said outlet ends of said secondary pipes and toward said material.

34. The pulse combustion system of claim 33, wherein said combustion chamber comprises a first section partially defined by said sidewall and a second section partially defined by said sidewall and said endwall, said fuel nozzle and said air conduit outlet are disposed within said first section, said exhaust outlet is disposed within said second section, and said air conduit extends through said second section.

35. The pulse combustion system of claim 33, wherein said ignitor comprises a spark plug or a pilot burner.

36. The pulse combustion system of claim 33, wherein said enclosure has at least one partition interposed between said combustion chamber and said secondary exhaust pipes.

37. The pulse combustion system of claim 33, wherein said enclosure has a lining of an insulation material.

38. A pulse combustion system, comprising:

a) at least two elongated combustion chambers each having at least one endwall, at least one sidewall with a length, and an exhaust outlet defined in said sidewall at a position generally proximate to said endwall;

b) each combustion chamber having at least one exhaust pipe having a first end extending from said combustion chamber and in alignment with said exhaust outlet;

c) each combustion chamber having at least one air conduit extending through said endwall of said combustion chamber and extending into said combustion chamber such that said exhaust outlet is disposed between said endwall and an outlet end of said air conduit;

d) each combustion chamber having at least one fuel nozzle extending thereinto such that said exhaust outlet is disposed between said endwall and fuel nozzle; and e) each combustion chamber having at least one igniter associated therewith, wherein for each combustion chamber fuel is entered thereinto through said fuel nozzle, air is entered thereinto through said air conduit and mixes with said fuel to form a fuel/air mixture, said fuel/air mixture is ignited by said igniter to form a burning fuel/air mixture and generate thermal and an acoustic pulse waves, said burning mixture expands in a helical swirl about said air conduit and along said length of said combustion chamber, said burning mixture combusts to produce exhaust gas, and said burning mixture or exhaust gas exhausts from said combustion chamber through said exhaust pipe.

39. The pulse combustion system of claim 38, wherein said two combustion chambers are arranged in a generally horizontal arrangement such that said air conduits are oppositely faced and axially aligned.

40. The pulse combustion system of claim 38, wherein said two combustion chambers are provided in a generally vertical arrangement.

41. The pulse combustion system of claim 38, wherein each of said air conduit extends coaxially into its respective combustion chamber.

* * * * *